United States Patent [19]

Burge

[11] 4,080,752

[45] Mar. 28, 1978

[54] TOY BLOCKS WITH CONDUITS AND FLUID SEAL MEANS

[76] Inventor: David A. Burge, 3594 Glencairn Rd., Shaker Heights, Ohio 44122

[21] Appl. No.: 573,788

[22] Filed: May 1, 1975

[51] Int. Cl.[2] ..... A63H 33/08

[52] U.S. Cl. ..... 46/25; 46/17; 46/26; 285/137 R; 285/321; 285/352; 285/DIG. 22; 285/155; 285/156; 285/157; 285/179

[58] Field of Search ..... 46/16, 17, 23, 25, 26, 46/29; 285/DIG. 22, 137 R, 321, 352, 325

[56] References Cited

U.S. PATENT DOCUMENTS

| | | | |
|---|---|---|---|
| 1,071,235 | 8/1913 | Hutton | 285/352 X |
| 1,896,917 | 2/1933 | Robinson | 285/99 X |
| 2,132,506 | 10/1938 | Allen | 285/352 X |
| 2,265,268 | 12/1941 | Culligan | 285/325 |
| 2,457,908 | 1/1949 | Meyerhoefer | 285/DIG. 19 |
| 2,812,958 | 11/1957 | Rogers | 285/321 X |
| 2,861,388 | 11/1958 | Favaretto | 46/16 |
| 2,950,130 | 8/1960 | Schneider | 285/325 X |
| 3,069,805 | 12/1962 | Burrows | 46/16 |
| 3,205,611 | 9/1965 | Onanian | 46/16 X |
| 3,548,849 | 12/1970 | Purcell et al. | 137/608 |
| 3,611,609 | 10/1971 | Reijnhard | 46/26 X |
| 3,667,785 | 6/1972 | Kapeker | 285/321 X |
| 3,779,584 | 12/1973 | Ignatjev | 285/137 R |
| 3,934,605 | 1/1976 | Legris | 285/325 X |

FOREIGN PATENT DOCUMENTS

| | | | |
|---|---|---|---|
| 1,962,884 | 12/1969 | Germany | 285/137 R |
| 44,346 | 3/1966 | Germany | 46/17 |
| 828,216 | 1/1952 | Germany | 46/17 |
| 635,593 | 9/1936 | Germany | 285/325 |
| 460,302 | 1/1937 | United Kingdom | 285/137 R |
| 632,030 | 11/1949 | United Kingdom | 285/325 |

*Primary Examiner*—F. Barry Shay
*Attorney, Agent, or Firm*—David A. Burge

[57] ABSTRACT

A toy construction set includes interconnectable building blocks. Fluid conduits are formed in the blocks. The blocks are interconnectable to communicate their fluid conduits. Resilient seals are carried by the blocks and form fluid tight connections between communicating conduits of interconnected blocks. Tubular conduit members are insertable into certain of the building block conduits, and the block-carried seals establish fluid tight communication therebetween. Flexible hoses are connectable with selected ones of the building blocks and conduit members. The blocks, the conduit members, and the hoses are interconnectable to form fluidic systems communicating such fluidic devices as pumps, motors, valves, nozzles and the like. A fluid reservoir and building base assembly is provided for use with the set when a fluid system is being constructed, and for storing the set components between periods of use.

15 Claims, 72 Drawing Figures

TOY BLOCKS WITH CONDUITS AND FLUID SEAL MEANS

CROSS REFERENCE TO RELEVANT PATENTS

Motion Transmitting Arrangement Combined With Toy Construction Kit, U.S. Pat. No. 3,475,849 issued Nov. 4, 1969 to Artur Fischer, here the "Piston Patent," the disclosure of which is incorporated by reference.

Blocks Connectable By Lateral Sliding, Including Means for Reducing Sliding Contact, U.S. Pat. No. 3,513,590 issued May 26, 1970 to Artur Fischer, here the "End Connector Patent," the disclosure of which is incorporated by reference.

Toy Construction Kit, U.S. Pat. No. 3,479,762 issued Nov. 25, 1969 to Artur Fischer, here the "Slotted Connector Patent," the disclosure of which is incorporated by reference.

BACKGROUND OF THE INVENTION

1. Field of the Invention

The present invention relates to toy construction sets, and more particularly to a construction set including a plurality of fluid conducting components interconnectable in fluid transmitting relationship to form a wide variety of fluidic systems.

2. Prior Art

Toy construction sets are known which utilize a plurality of interconnectable structural elements. The elements typically are provided with male, female, or male and female coupling portions so that they can be connected by mating complementary coupling portions or by using separate coupling elements. Such construction sets are described in the referenced End Connector Patent and the referenced Slotted Connector Patent.

While much has been done to develop toy construction sets including a wide variety of mechanical, optical, electrical, and electronic components, little has been done to provide construction kits with fluidically operable components, or with interconnectable fluid transmitting components. While present day toy construction sets are highly instructive in that they enable the novice to build complex, sophisticated mechanical, optical, electrical and electronic systems, such construction sets fail to provide comparable instructive opportunities for the construction of fluidic systems.

The referenced Piston Patent discloses a piston in a cylinder as an element of a construction set. While some such fluidic components are known in construction sets, no prior toy construction sets have provided a highly versatile set of interconnectable fluid-transmitting and fluid-operational components. It is such versatility which presents a challenge to persons using construction kits and which accounts for their widespread commercial acceptance.

SUMMARY OF THE INVENTION

The present invention overcomes the foregoing and other drawbacks of the prior art by providing a highly versatile construction set with interconnectable components capable of forming a wide variety of fluidic systems.

In accordance with one aspect of the present invention, a toy construction set is provided having interconnectable building blocks with fluid conduits formed through the blocks. When the blocks are interconnected, their fluid conduits communicate to form one or more common fluid passages. Resilient seals form fluid tight connections between communicating conduits of the interconnected building blocks.

With the preferred practice of the present invention, the seals are conventional O-rings which are carried in grooves formed in the building blocks. Where two building blocks are interconnected such that conduits in each of the blocks are communicated, at least one of the blocks carries an O-ring seal that inhibits fluid leakage at the juncture of the communicating conduits. In preferred practice, both of the interconnected blocks carry O-ring seals, and such seals engage each other at the juncture of the communicating conduits to inhibit fluid leakage.

The conduits formed in the blocks preferably have end regions of a substantially uniform first diameter. O-ring seals having an inner diameter less than such first diameter are carried by the blocks at the ends of such conduits. Tubular conduit members having outer diameters which will slip fit within such conduit end regions are insertable through such seals and into such conduit end regions, whereby the seals establish fluid tight connections between the conduit members and the conduit end regions. The conduit members preferably have circumferentially extending grooves spaced inwardly from their ends to receive the inner diameters of the seals, whereby the seals act as detents to inhibit relative movement between the conduit members and the conduit end regions once the seals have been received in such grooves.

In accordance with another aspect of the present invention, certain of the building blocks are provided with tubular projections receivable within the end regions of flexible hoses to establish fluid tight connection between such blocks and hoses. By this arrangement, fluid can be transmitted between separate, relatively rigid systems of interconnected fluid-communicative elements by flexible members. Such interconnected fluid systems can therefore be relatively movable.

Two types of fluid communicative interconnectable blocks are preferably included in construction sets embodying the present invention. One type of block has a single fluid conduit extending between separate faces of the block for communication with similar mono-conduit blocks to establish a single fluid passage. The other type of block has two fluid conduits each extending between two faces of the block for communication with similar bi-conduit blocks to establish dual fluid passages. Still other blocks provided in the set are operable to permit interconnection of the mono-conduit and bi-conduit blocks whereby the dual conduits of the bi-conduit blocks can be selectively communicated with a single conduit or with separate conduits in mono-conduit block systems.

In accordance with still another aspect of the present invention, a construction set includes a pair of building blocks each having a fluid conduit formed therein. The blocks are interconnectable in a first mode which establishes fluid communication therebetween, and are interconnectable in a second mode which does not establish fluid communication therebetween.

In accordance with other aspects of the present invention, fluid operating components such as pumps, motors, valves, nozzles and the like can be interconnected by the described fluid conducting elements. The working fluid communicated in such systems can be a gas such as air, or a liquid such as water or oil.

In accordance with still other aspects of the present invention, a fluid reservoir and base assembly having upstanding walls is provided for use particularly where the working fluid is a liquid. A funnel-like structure is positionable atop the reservoir to direct fluid into the reservoir. Building base components are provided for positioning within the funnel-like structure to assist in supporting an assembled fluid system and to return discharge working fluid to the reservoir.

As will be apparent from the foregoing summary, it is a general object of the present invention to provide a novel and improved toy construction set.

It is a further object to provide a novel and improved construction set which can be used to construct a wide variety of fluidic systems.

It is a further object to provide novel and improved fluid communicable components for a construction set.

It is still another object to provide novel and improved methods of constructing fluidic systems with a construction set having interconnectable components.

Other objects and a fuller understanding of the invention described and claimed in the present application may be had by referring to the following description and claims taken in conjunction with the accompanying drawings.

DESCRIPTION OF THE PREFERRED EMBODIMENTS

Figure 1:
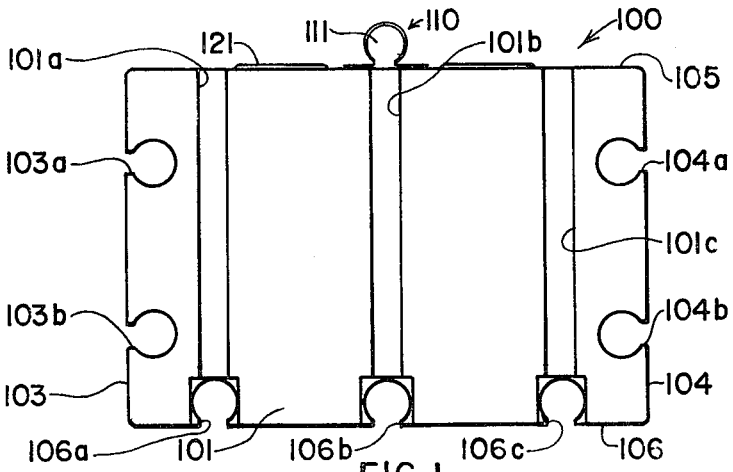
FIG. 1 is a side elevational view of a first construction block embodying certain aspects of the present invention.
Figure 2:
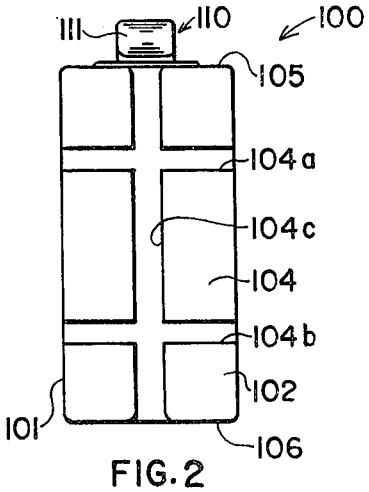
FIG. 2 is an end elevational view of the first block.
Figure 3:
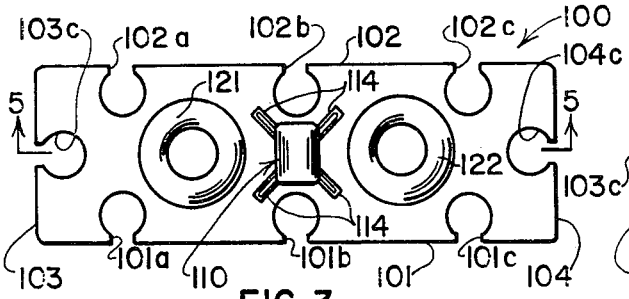
FIGS. 3 and 4 are top plan and bottom plan views of the first block.
Figure 4:
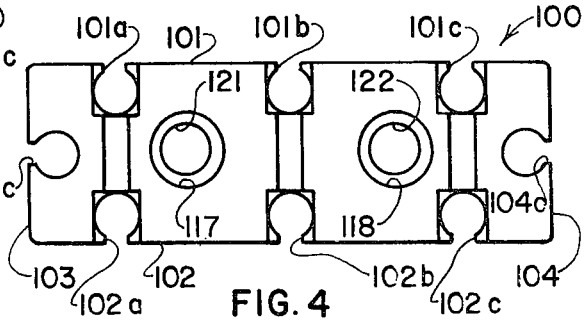
Figure 5:
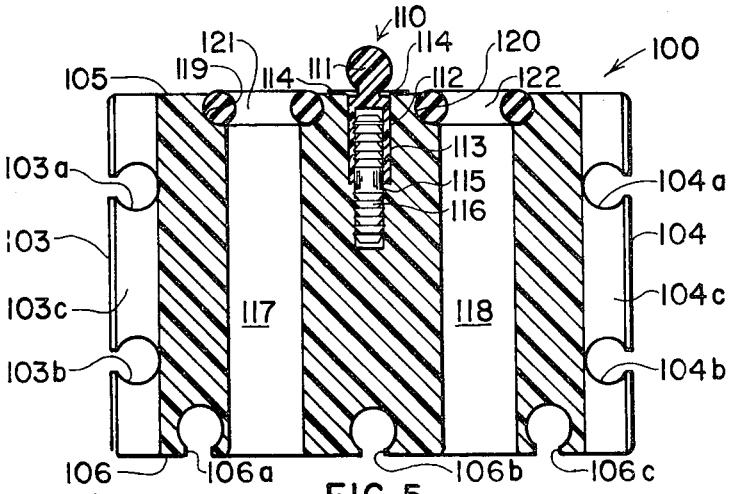
FIG. 5 is a sectional view of the first block as seen from a plane indicated by a line 5—5 in FIG. 3.

Referring to FIGS. 1–4, a building block is indicated generally by the numeral 100. The block 100 has substantially the form of a right parallelepiped with six substantially rectangular faces 101, 102, 103, 104, 105, 106. The faces 101–104 will be called sides of the block 100, the face 105 will be called the top of the block 100, and the face 106 will be called the bottom of the block 100.

A number of undercut grooves of substantially identical cross section are provided in the faces 101–104 and 106. Three of these grooves 101*a*, 101*b*, 101*c* are provided in the side face 101. Similar grooves 102*a*, 102*b*, 102*c* are provided in the side face 102. Similar intersecting grooves 103*a*, 103*b*, 103*c* and 104*a*, 104*b*, 104*c* are formed in the side faces 103, 104. Similar grooves 106*a*, 106*b*, 106*c* are formed in the bottom face 106.

Building blocks having undercut grooves of this general type are described in the referenced End Connector Patent. As will be appreciated, building blocks constructed in accordance with the preferred practice of the present invention may be provided with any convenient number of such undercut grooves to facilitate their interconnection with one another and with other blocks such as are described in the referenced End Connector Patent.

A male coupler 110 is carried by the block 100. The coupler 110 includes an upstanding head portion 111 and an integrally formed depending anchor portion 112. As will be apparent, certain building blocks constructed in accordance with the present invention need not be provided with a male coupler 110, and alternatively can be provided with any convenient number of such male couplers to facilitate their interconnection with one another and with other blocks such as are described in the referenced End Connector Patent.

The head portion 111 is undercut and is adapted to be received in such undercut grooves as are formed in the sides and bottom of the block 100. While the head portion 111 is shown as being elongated in a direction parallel to the plane of the top 105 of the block 100, and as having a substantially circular cross section, other head portion configurations can be employed, such as those described in the referenced End Connector Patent.

The anchor portion 112 has a central stem 113 and four radially extending wings 114. The stem 113 has a downwardly opening bore 115. One end region of a pin 116 is pressed into the bore 115. The other end region of the pin 116 depends below the stem 113. Both end regions of the pin 116 are provided with circumferentially extending, sawtooth shaped ridges. The anchor portion 112 and the pin 116 are received within and secured to the block 100 as described in the referenced End Connector Patent. The wings 114 extend slightly above the top face 114, as described in the referenced End Connector Patent.

The dimensions of the block 100 are preferably selected such that its width and height and thickness are multiples of a common dimensional unit. The width of the block 100, i.e., the distance between the side faces 103, 104, is preferably 3 units long. The height of the block 100, i.e. the distance between the top and bottom faces 105, 106, is preferably 2 units long. The thickness of the block 100, i.e., the distance between the side faces 101, 102, is preferably 1 unit long.

The body of the block 100 is preferably formed from a relatively hard synthetic plastic material. The coupler 110 is preferably formed from a somewhat more elastic synthetic plastic material. The pin 116 is preferably formed from metal.

Two parallel conduits or passages 117, 118 are formed within the body of the block 100. Each of the passages 117, 118 opens through the top 105 and the bottom 106 of the block 100. Each of the passages 117, 118 is enlarged as by an annular recess 119, 120 near its juncture with the top face 105. A pair of resilient seals 121, 122 are positioned in the recesses 119, 120.

The seals 121, 122 are preferably formed from a synthetic plastic material which is substantially more resilient than are the materials which form the body of the block 100 and the coupler 110. Conventional O-ring seals having a solid torrus of resilient plastic material are preferred.

The annular recesses 119, 120 are configured to snugly receive the seals 121, 122. The recesses 119, 120 have curved inner wall portions which intersect with the top face 105 and which overlie peripheral portions of the seals 121, 122 to retain the seals 121, 122 in the recesses 119, 120. The seals 121, 122 project above the top face 105 to a level slightly above the upper ends of the wings 114.

The seals 121, 122 have an inner diameter which is less than that of the passages 117, 118. As will be explained, the projection of the seals 121, 122 inwardly of the passages 117, 118 may be utilized to effect sealing engagement with certain tubular conduit members.

The block 100 will be called the "double conduit" block. A wide variety of building blocks can be formed embodying the basic features of the "double conduit" block 100, as will be described below. Since most of the blocks to be described below have features that correspond to those of the block 100, corresponding features will be designated by numerals differing by one or multiples of the number one hundred from the numerals used in conjunction with the block 100.

Figure 6:
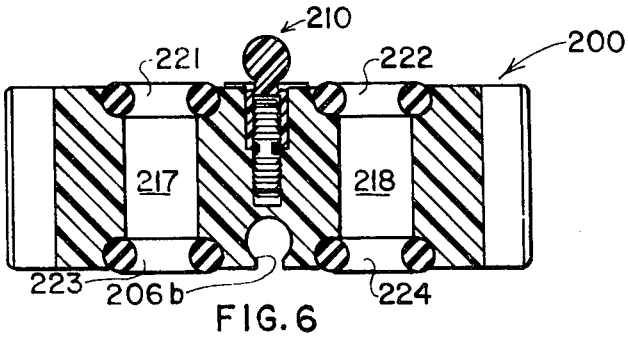
FIG. 6 is a sectional view of a second construction block embodying certain aspects of the present invention.

Referring to FIG. 6, a block having width, height and thickness dimensions of 3 units, 1 unit, and 1 unit, respectively is indicated generally by the numeral 200. The principal structural difference between the blocks 100, 200 is that the block 200 is provided with O-ring seals 221, 222 and 223, 224 at opposite ends of its conduits or passages 217, 218. A further but minor difference is that some of the undercut side and bottom face passages provided in the block 100 are eliminated from the block 200.

In the preferred practice of the present invention, all building blocks are provided with an O-ring seal at each location where a conduit opens through a block face, as is shown in FIG. 6. The provision of an O-ring seal at each conduit opening provides a more secure seal between interconnected blocks than is achieved where only one of two interconnected blocks carries a seal.

Figure 7:
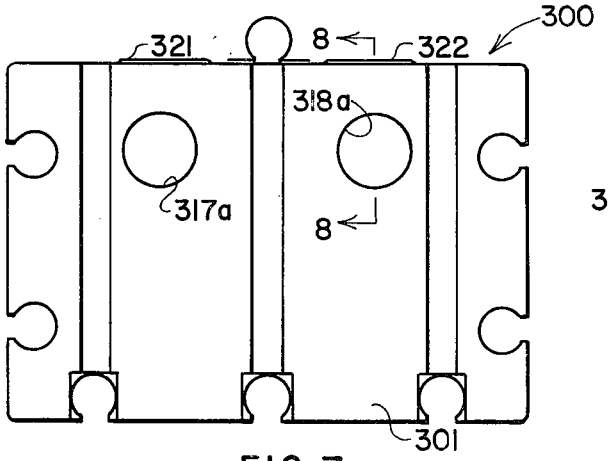
FIG. 7 is a side elevational view of a third construction block embodying certain aspects of the present invention.
Figure 8:
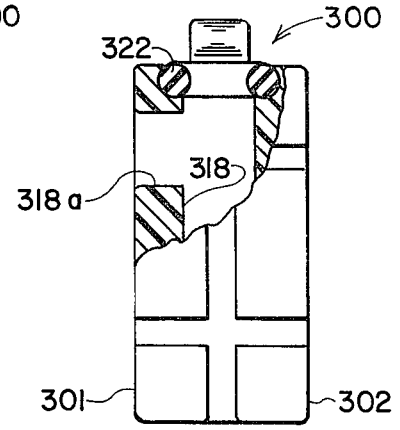
FIG. 8 is an end elevational view of the third block with portions broken away to a plane indicated by a line 8—8 in FIG. 7.

Referring to FIGS. 7 and 8, a building block 300 is illustrated which is substantially identical to the block 100 except for the provision of added branches 317*a*, 318*a* in its conduits 317, 318. The branches 317*a*, 318*a* open through the front face 301. The block 300 is called a "double-T" block.

Figure 9:
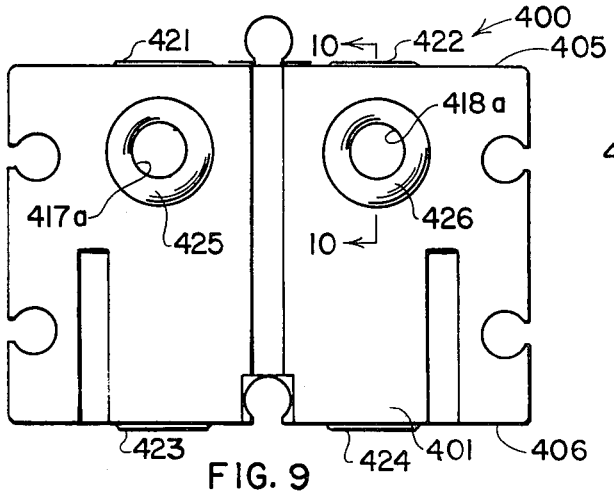
FIG. 9 is a side elevational view of a fourth construction block embodying certain aspects of the present invention.
Figure 10:
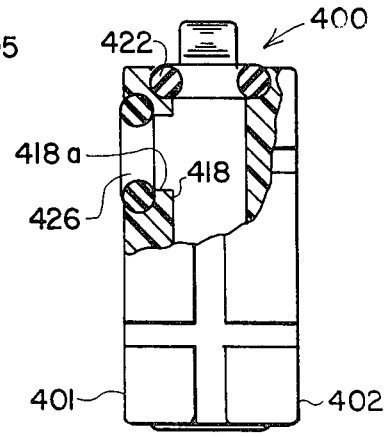
FIG. 10 is an end elevational view of the fourth block with portions broken away to a plane indicated by a line 10—10 in FIG. 9.

Referring to FIGS. 9 and 10, a preferred embodiment of a "double-T" block is indicated by the numeral 400. The principal difference between the "double-T" blocks 300, 400 is that the block 400 is provided with O-ring seals 423, 424 and 425, 426 where the passages 417, 418 and branches 417*a*, 418*b* open through the faces 406 and 401 respectively.

Figure 11:
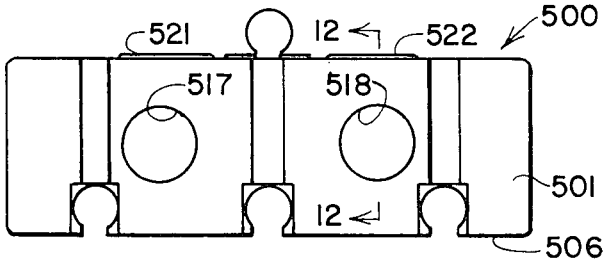
FIG. 11 is a side elevational view of a fifth construction block embodying certain aspects of the present invention.
Figure 12:
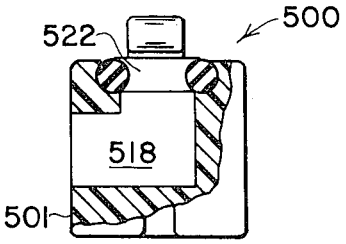
FIG. 12 is an end elevational view of the fifth block with portions broken away to a plane indicated by a line 12—12 in FIG. 11.

Referring to FIGS. 11 and 12, a "double L" block is indicated generally by the numeral 500. The block 500 has width, height, and thickness dimensions of 3, 1 and 1 units, respectively and otherwise differs from the block 100 principally in that its passages 517, 518 are of L-shape and open through the front face 501 instead of through a bottom face.

Figure 13:
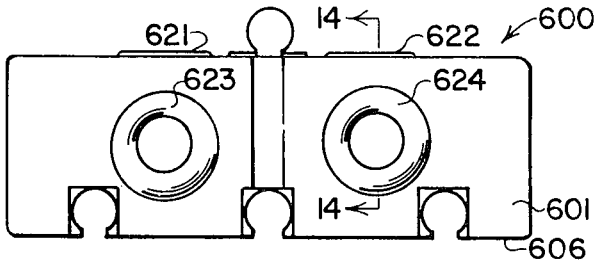
FIG. 13 is a side elevational view of a sixth construction block embodying certain aspects of the present invention.
Figure 14:
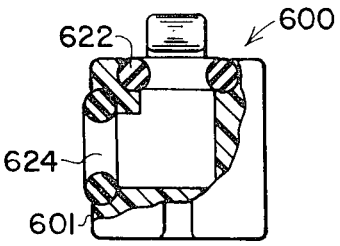
FIG. 14 is an end elevational view of the sixth block with portions broken away to a plane indicated by a line 14—14 in FIG. 13.

Referring to FIGS. 13 and 14, a preferred embodiment of a "double-L" block is indicated by the numeral 600. The principal difference between the "double-L" blocks 500, 600 is that the block 600 is provided with O-ring seals 623, 624 where the passages 617, 618 open through the face 601.

Figure 15:
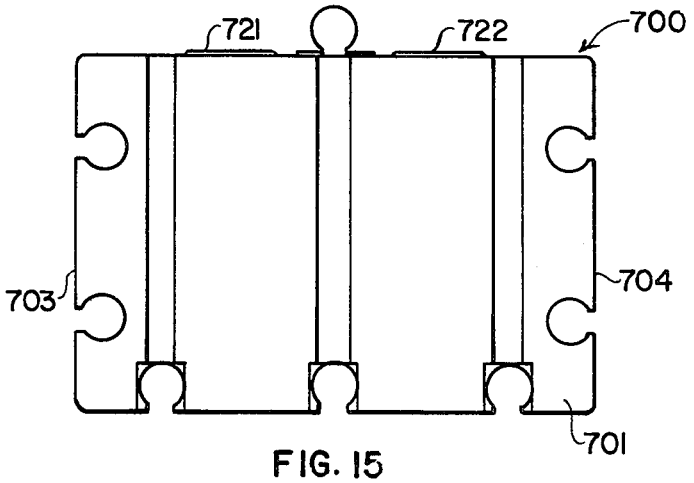
FIG. 15 and 16 are side and end elevational views of a seventh construction block embodying certain aspects of the present invention.
Figure 16:
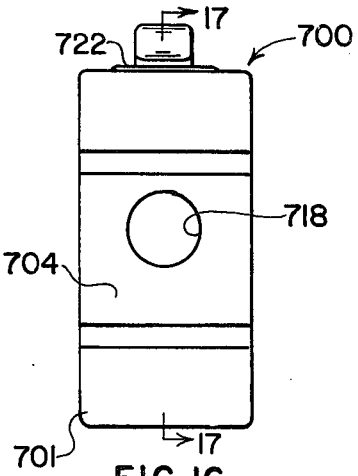
Figure 17:
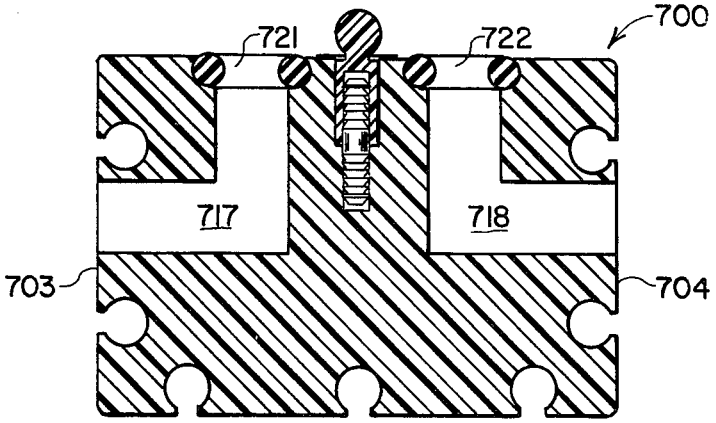
FIG. 17 is a sectional view of the seventh block as seen from a plane indicated by a line 17—17 in FIG. 16.

Referring to FIGS. 15, 16 and 17, a "double side L" block is indicated generally by the numeral 700. The block 700 differs from the block 100 principally in that its passages 717, 718 are of L-shape and open through the side faces 703, 704 instead of through a bottom face.

Figure 18:
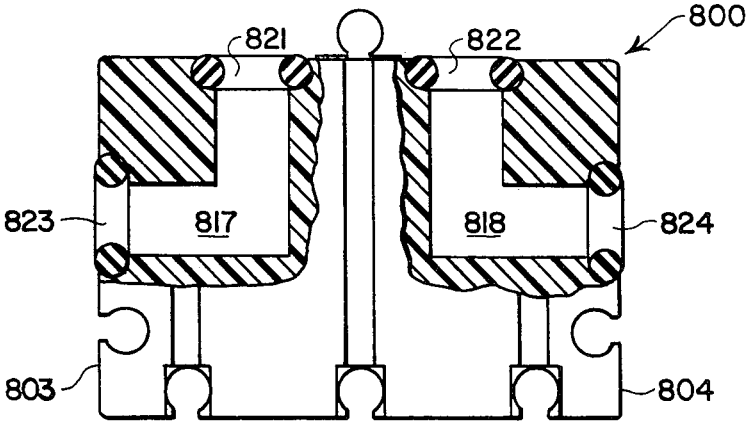
FIG. 18 is a side elevational view of an eighth construction block with portions broken away to illustrate certain aspects of the present invention.
Figure 19:
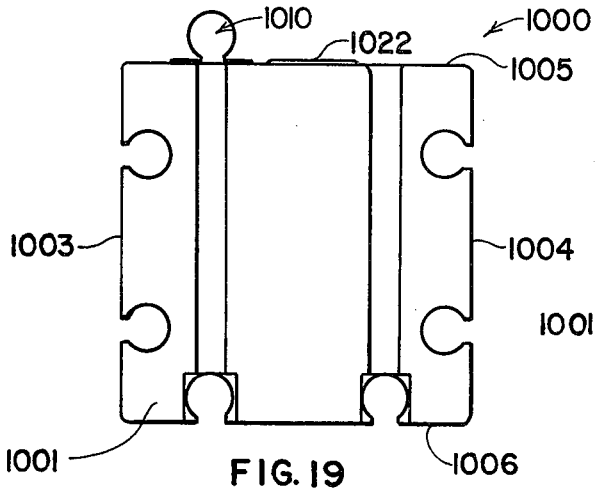
FIGS. 19 and 20 are side and end elevational views of a ninth construction block embodying certain aspects of the present invention.
Figure 20:
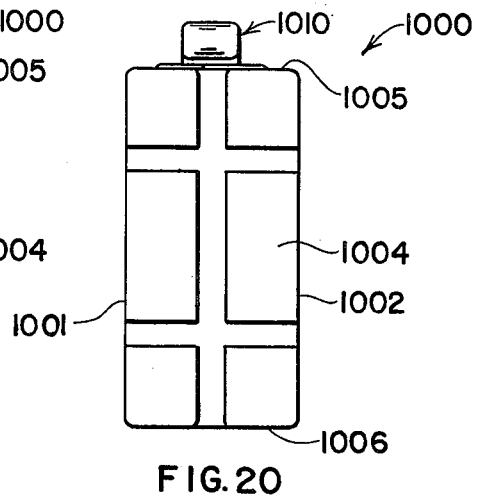
Figure 21:
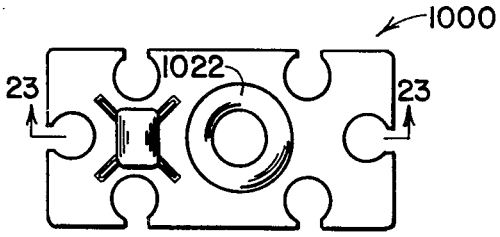
FIGS. 21 and 22 are top and bottom plan views of the ninth block.
Figure 22:
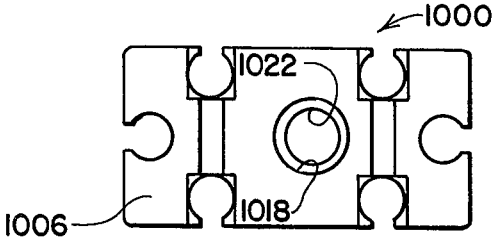
Figure 23:
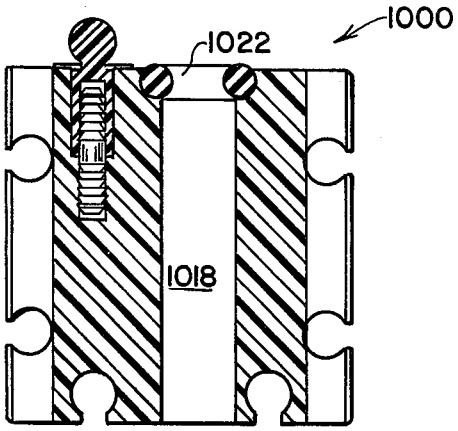
FIG. 23 is a sectional view of the ninth block as seen from a plane indicated by a line 23—23 in FIG. 21.

Referring to FIG. 18, a preferred embodiment of a "double side L" block is indicated by the numeral 800. The principal difference between the "double side L" blocks 700, 800 is that the block 800 is provided with O-ring seals 823, 824 where the passages 817, 818 open through the faces 803, 804.

Referring to FIGS. 19–23, a "single conduit" block is indicated generally by the numeral 1000. The block 1000 differs from the block 100 in that its width is 2 units rather than 3 units, and it has ony one through conduit 1018 and one O-ring seal 1022. Other differences such as a lesser number of undercut sidewall grooves and an off-center positioning of the coupler 1010 will be apparent from an inspection of FIGS. 19–23.

Figure 24:
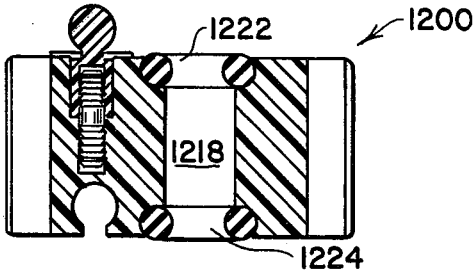
FIG. 24 is a sectional view of a tenth construction block embodying certain aspects of the present invention.
Figure 25:
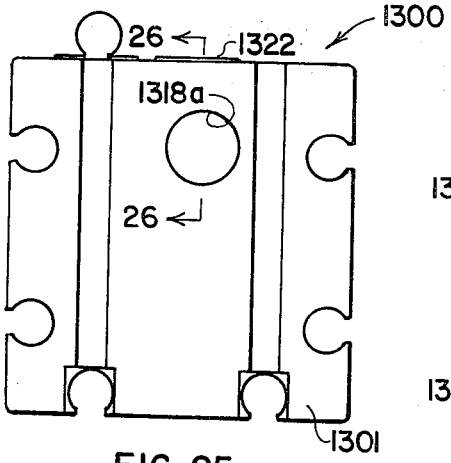
FIG. 25 is a side elevational view of an eleventh construction block embodying certain aspects of the present invention.
Figure 26:
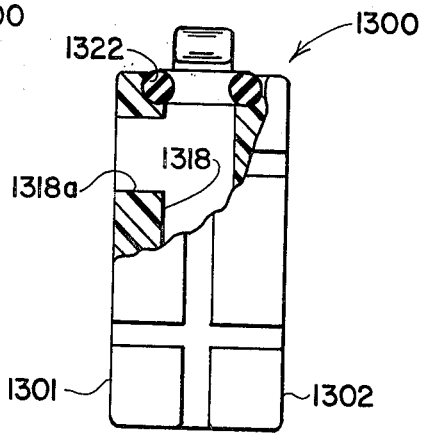
FIG. 26 is an end elevational view of the eleventh block with portions broken away to a plane indicated by a line 26—26 in FIG. 25.
Figure 27:
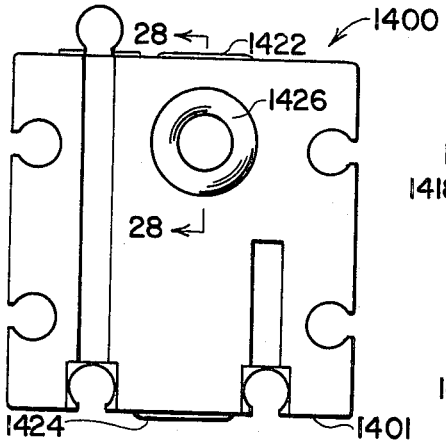
FIG. 27 is a side elevational view of a twelfth construction block embodying certain aspects of the present invention.
Figure 28:
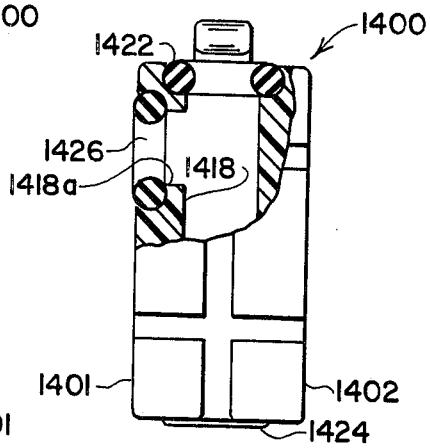
FIG. 28 is an end elevational view of the twelfth block with portions broken away to a plane indicated by a line 28—28 in FIG. 27.
Figure 29:
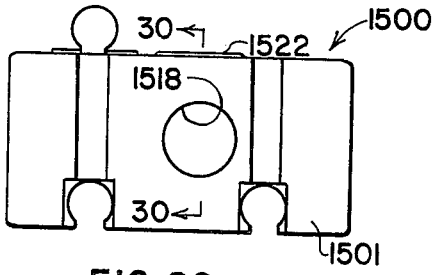
FIG. 29 is a side elevational view of a thirteenth construction block embodying certain aspects of the present invention.
Figure 30:
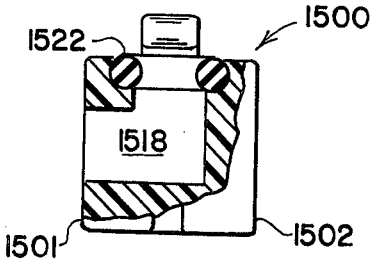
FIG. 30 is an end elevational view of the thirteenth block with portions broken away to a plane indicated by a line 30—30 in FIG. 29.
Figure 31:
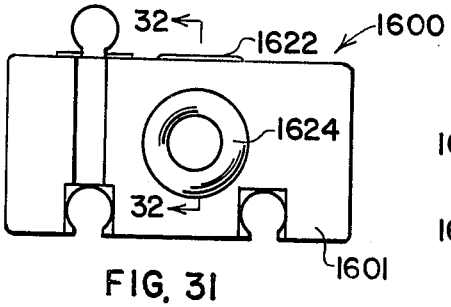
FIG. 31 is a side elevational view of a fourteenth construction block embodying certain aspects of the present invention.
Figure 32:
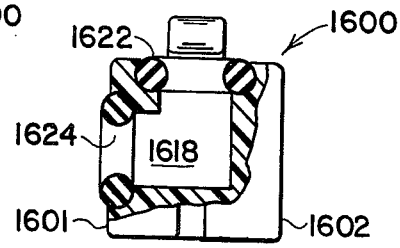
FIG. 32 is an end elevational view of the fourteenth block with portions broken away to a plane indicated by a line 32—32 in FIG. 31.
Figure 33:
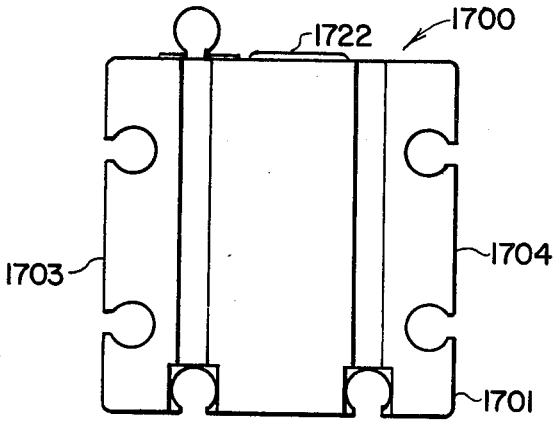
FIGS. 33 and 34 are side and end elevational views of a fifteenth construction block embodying certain aspects of the present invention.
Figure 34:
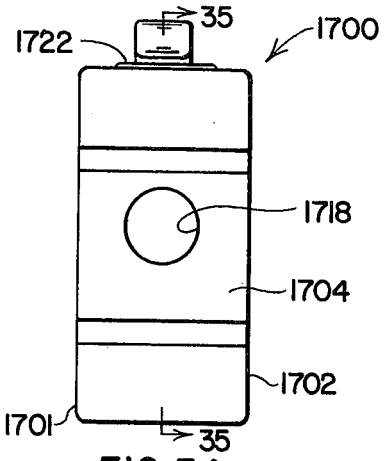
Figure 35:
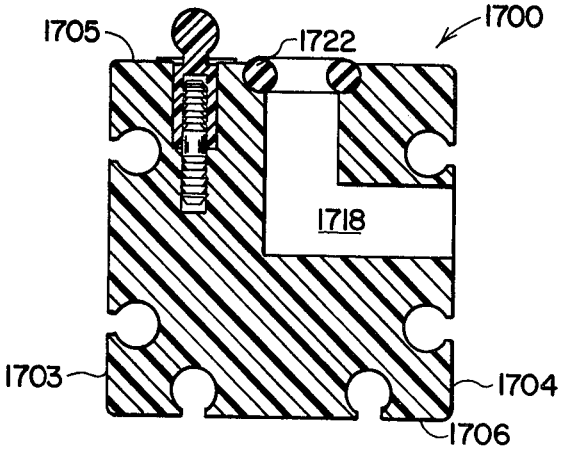
FIG. 35 is a sectional view of the fifteenth block as seen from a plane indicated by a line 35—35 in FIG. 34.
Figure 36:
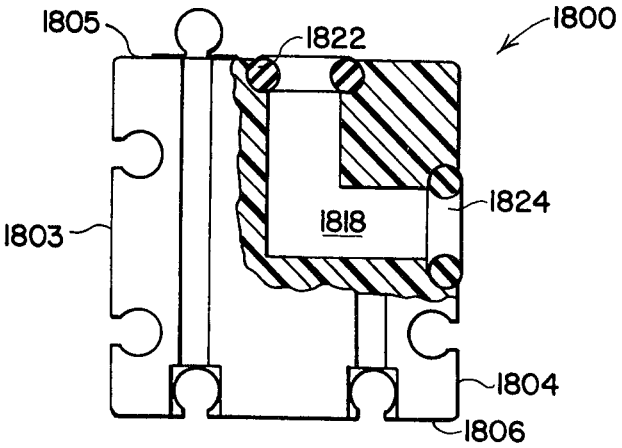
FIG. 36 is a side elevational view of a sixteenth construction block with portions broken away to illustrate certain aspects of the present invention.

FIGS. 24; 25, 26; 27, 28; 29, 30; 31, 32; 33–35; and 36 show blocks 1200, 1300, 1400, 1500, 1600, 1700 and 1800 respectively which correspond to blocks 200, 300, 400, 500, 600, 700 and 800 much as the block 1000 corresponds to the block 100. The blocks 1300, 1400 are called "single T" blocks. The blocks 1500, 1600 are called "single L" blocks. The blocks 1700, 1800 are called "single side L" blocks.

Figure 37:
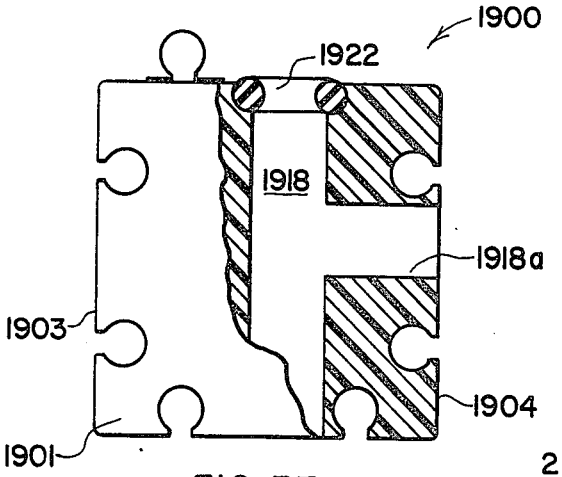
FIG. 37 is a side elevational view of a seventeenth construction block with portions broken away to indicate certain aspects of the present invention.
Figure 38:
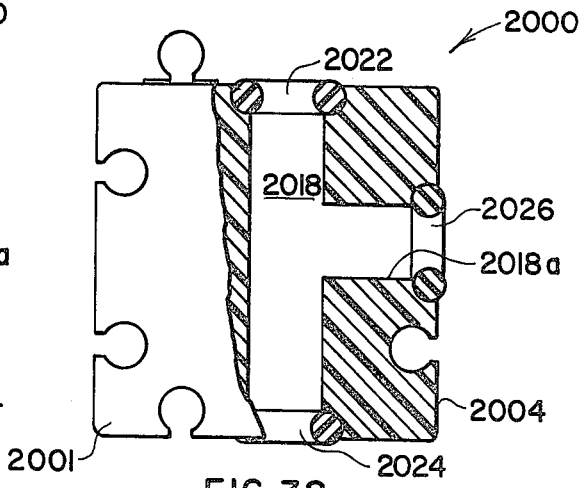
FIG. 38 is a side elevational view of a eighteenth construction block with portions broken away to indicate certain aspects of the present invention.

Referring to FIGS. 37 and 38, two "single side T" blocks 1900, 2000 are shown. The "single side T" blocks 1900, 2000 differ from the "single T" blocks 1300, 1400 principally in that their branch passages 1918, 2018 open through sidewalls 1904, 2004 rather than through front walls.

Figure 39:
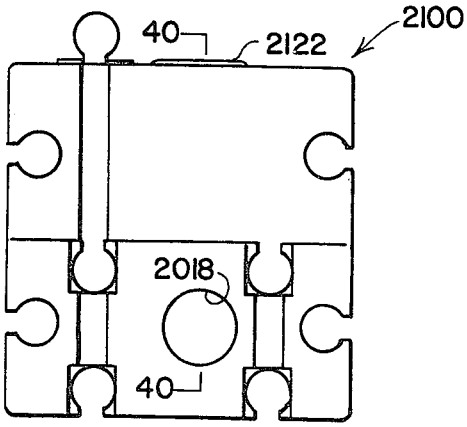
FIG. 39 is a side elevational view of an nineteenth construction block embodying certain aspects of the present invention.
Figure 40:
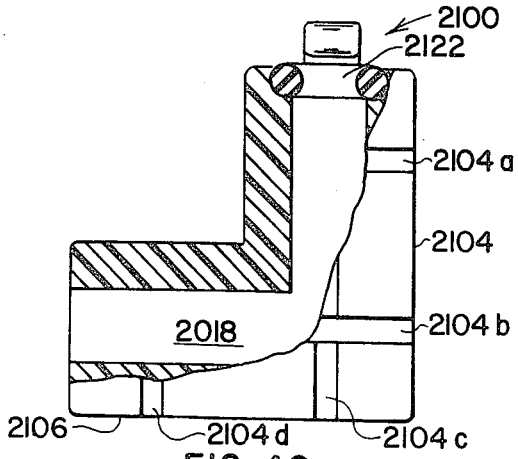
FIG. 40 is an end elevational view of the nineteenth block with portions broken away to a plane indicated by a line 40—40 in FIG. 39.

Referring to FIGS. 39, 40 an "L-shaped single L" block is indicated generally by the numeral 2100. The block 2100 differs from the "single L" block 1500 principally in that certain of its faces are extended such that both branches of its L-shaped passage 2018 are of longer length. As will be apparent, a similar "L-shaped double L" block can be provided, and O-ring seals can be provided at both ends of each of the L-shaped passages.

Figure 41:
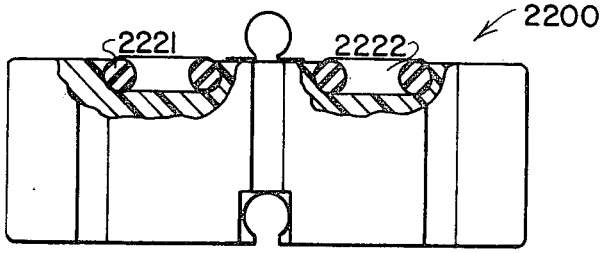
FIGS. 41 and 42 are side elevational views of a twentieth and a twenty-first construction block with portions broken away to illustrate certain aspects of the present invention.
Figure 42:
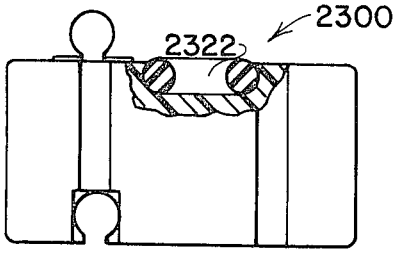

Referring to FIGS. 41, 42 double and single "cap" blocks are indicated generally by the numerals 2200, 2300. The cap blocks 2200, 2300 differ principally from the conduit blocks 200, 1200 in that no through conduits are provided in the blocks 2200, 2300. The cap blocks 2200, 2300 can be used to close an open end on any one of the previously described blocks.

Figure 43:
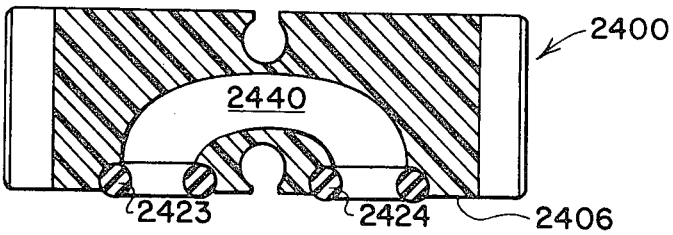
FIG. 43 is a sectional view of a twenty-second construction block embodying certain aspects of the present invention.

Referring to FIG. 43, a "transfer" block is indicated generally by the numeral 2400. The transfer block 2400 differs from the double conduit block 200 in that only one through passage 2440 is provided, and the passage 2440 has two openings through the bottom face 2406.

The "transfer" block 2400 is used when connected to such a block as the double conduit block 200 to communicate its passages 217, 218.

Figure 44:
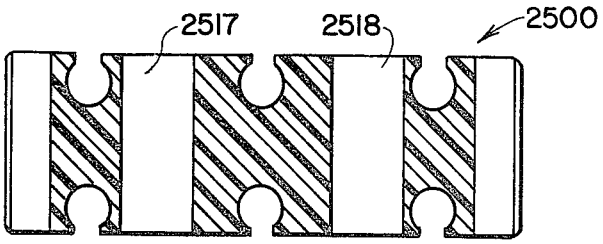
FIGS. 44—49 are sectional views of, twenty-third, twenty-fourth, twenty-fifth, twenty-sixth, twenty-seventh and twenty-eighth construction blocks each embodying certain aspects of the present invention.
Figure 45:
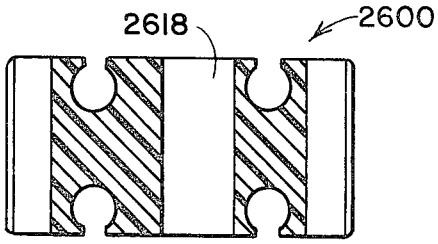
Figure 46:
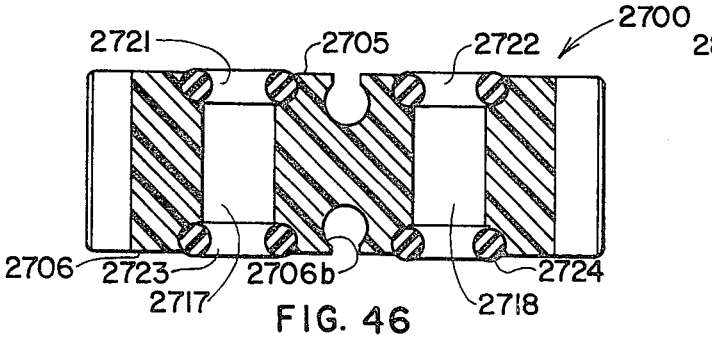
Figure 47:
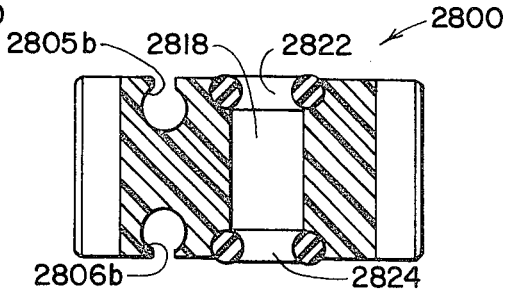

Referring to FIGS. 44 and 45, double and single conduit blocks 2500, 2600 are shown which differ from the blocks 200, 1200 in that they carry neither male couplers nor O-rings. Similar female double and single conduit blocks provided with O-rings are indicated by the numerals 2700, 2800 in FIGS. 46 and 47.

Figure 48:
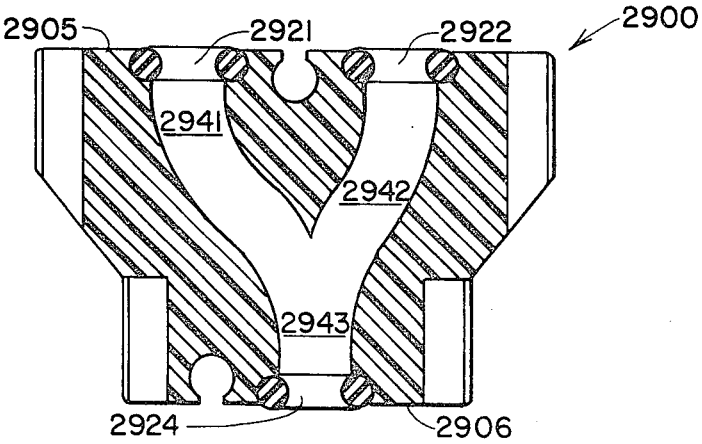

Referring to FIG. 48, a "Y-junction" block is indicated generally by the numeral 2900. The "Y-junction" block has a through passage with branches 2941, 2942, 2943. The branches 2941, 2942 open through the top face 2905. The branch 2943 opens through the bottom face 2906. O-ring seals 2921, 2922, 2924 are provided at the ends of the branches 2941, 2942, 2943. The "Y-junction" block 2900 is used to join any of the described double and single conduit blocks and to communicate the passages in the connected double conduit block.

Figure 49:
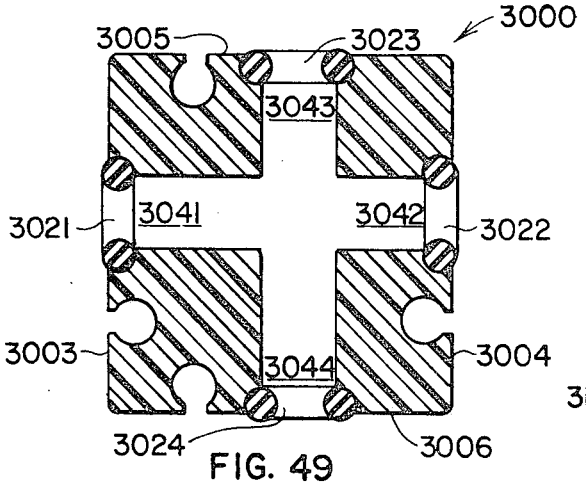

Referring to FIG. 49, a "4-way junction" block is indicated by the numeral 3000. The block 3000 has a through passage with four branches 3041, 3042, 3043, 3044 which open respectively through the faces 3003, 3004, 3005, 3006. O-ring seals 3021, 3022, 3023, 3024 are provided at the ends of the branches 3041, 3042, 3043, 3044. The "4 way junction" block 3000 is used to communicate passages in any four of the described single conduit blocks. As will be apparent, a "double 4 way junction" block can be provided to separately communicate the separate passages in four of the described double conduit blocks.

Figure 50:
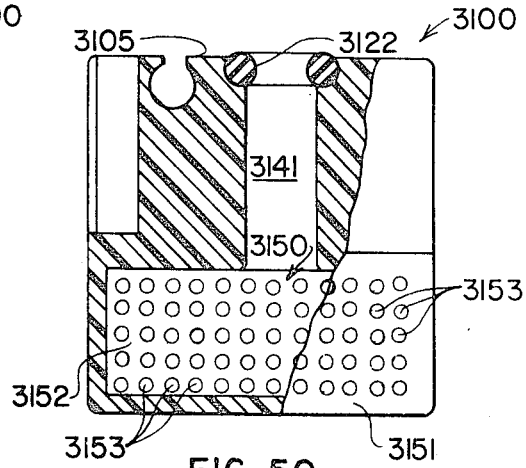
FIG. 50 is a side elevational view of a twenty-ninth construction block with portions broken away to illustrate certain aspects of the present invention.

Referring to FIG. 50, an "intake" block is indicated generally by the numeral 3100. The intake block 3100 has a passage 3141 which is provided with an O-ring seal 3123 where it opens through the top face 3105. A chamber 3150 is defined within the block 3100 in commuincation with the passage 3141. A pair of side plates 3151, 3152 are adhered to opposite sides of the block 3100. the side plates are provided with a plurality of holes 3153 which communicate with the chamber 3150. The "intake" block 3100 is used to filter fluid as its is drawn through the holes 3153, into the chamber 3150, and into the passage 3141 as by a pump which will be described.

Figures 51, 52, 53:
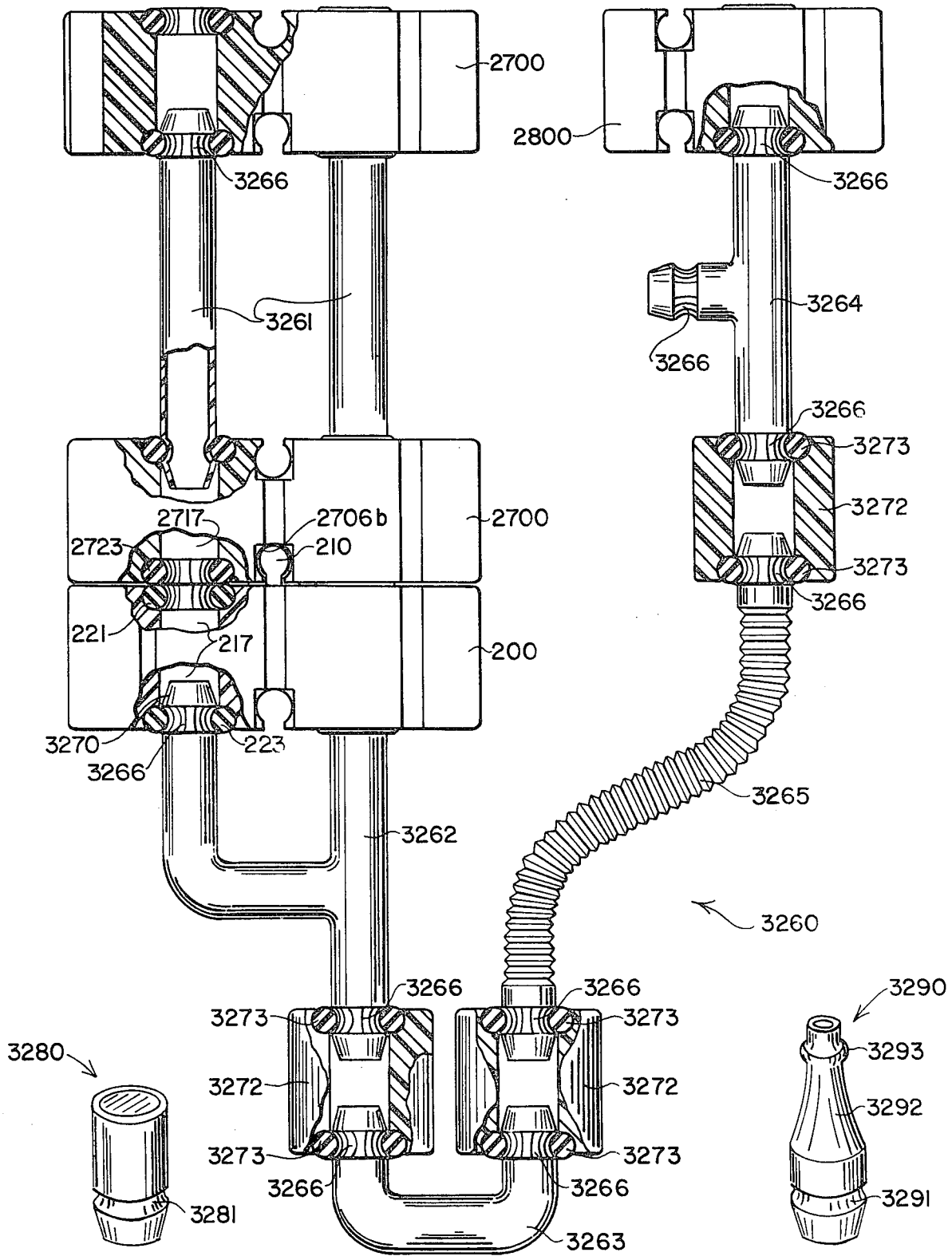
FIG. 51 is a side elevational view of several assembled components each constructed in accordance with certain aspects of the present invention, some of the components having portions broken away.
FIGS. 52 and 53 are perspective views of two additional components constructed in accordance with certain aspects of the present invention.

Referring to FIG. 51, an assembly of a number of fluid system components of the present invention is indicated generally by the numeral 3260. Shown centrally in FIG. 51 are two double conduit blocks 200, 2700 which are interconnected with the coupler 210 positioned in the groove **2706*b*. As is shown in FIG. 51, when conduit blocks such as 200, 2700 which each carry an O-ring 221, 2723 are interconnected with the O-rings 221, 2733 in engagement, the O-rings 221, 2723 compressively engage each other and establish a fluid tight connection between aligned passages 217, 2717. During connection of the blocks 200, 2700 as the coupler 219 is moved into the passage 2706*b*, the O-rings 221, 2723** deform or compress and slide relative to each other to establish a firm sealing engagement therebetween.

In accordance with another feature of the present invention, tubular conduit members of various configurations are provided which are connectable with the previously described blocks. Referring to FIG. 51, straight rigid conduit members are indicated by the numeral 3261; a rigid Y-shaped rigid conduit member is indicated by the number 3262; a rigid U-shaped conduit member is indicated by the numeral 3263; a rigid T-shaped conduit member is indicated by the numeral 3264; and a flexible tubular conduit member is indicated by the numeral 3265.

Each of the conduit members 3261-3265 has rigid end regions provided with a circumfernetial groove 3266. These rigid conduit end regions have an outer diameter which permits their being loosely received in the passages of all the above described conduit carrying blocks. As is shown by way of example in FIG. 51, the Y-shaped conduit member 3262 has an end region 3270 which is extensible into the passage 217 of the block 200 to a position where the O-ring 223 engages the end region groove 3266.

During insertion of the end region 3270 into the passage 217, the O-ring 223 is compressed to permit the end region 3270 to pass through the O-ring. Once the end region 3270 has passed through the O-ring 223 to a position where the O-ring 223 can expand and seat in the groove 3226, the O-ring establishes a releasable sealing connection between the block 200 and the conduit member 3262.

Removal of the end region 3270 from the block 200 is effected simply by pulling on the Y-shaped conduit member 3262 to pull the end region 3270 out of the passage 217. If, in the process of removing the end region 3270 from the block 200 the O-ring 223 should also be pulled out of the block 200, it can easily be removed from the end region 3270 and snaped back into the block 200.

Referring again to FIG. 51, tubular connector blocks can be used if desired to interconnect the various tubular conduit members. Such tubular connector blocks are indicated by the numeral 3272. The blocks 3272 are preferably provided with axially extending undercut grooves, not shown for connection with such blocks as are described in the referenced End Connector Patent. O-ring seals 3273 are carried in opposite ends of the blocks 3272 in the manner described in conjunction with the block 100.

Referring to FIGS. 52 and 53, two additional tubular members are indicated by the numerals 3280, 3290. The member 3280 is a "plug" having no conduit formed therethrough but having a circumferential groove 3281 on one end region. The plug 3280 is insertable into the passages of the aforedescribed blocks to effect a closure of such passage. The member 3290 is a nozzle having a circumferential groove 3291 on one end region and a tapered tip 3292 on the other end region. The larger of the nozzle end regions is insertable into the passages of the previously described blocks. An enlarged circumferential rib 3293 is formed on the tapered tip to facilitate connection with a flexible hose, as will be described.

Figure 54:
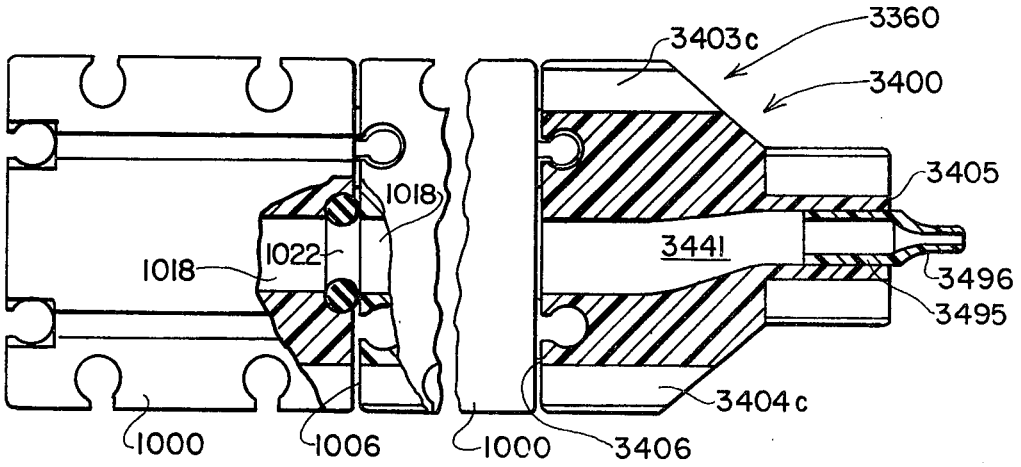
FIG. 54 is a side elevational view several assembled components each constructed in accordance with certain aspects of the present invention, some of the components having portions broken away.

Referring to FIG. 54, another assembly of a number of fluid system components of the present invention is indicated generally by the numeral 3360. Shown connected one to another are two of the single conduit blocks 1000 and a "nozzle" block 3400. As is shown in FIG. 54, when conduit blocks such as the blocks 1000 are connected, only one O-ring seal 1022 is provided to seal the juncture between the aligned passages 1018. In this arrangement, the seal 1022 compressively engages the bottom face 1006 of one of the blocks 1000 to establish fluid tight communication between the aligned passages 1018.

The "nozzle" block 3400 has a single passage 3441 which opens through faces 3405, 3406. A nozzle member 3495 extends into and is adhered within the passage 3441, and has a tapered tip 3496 that projects beyond the face 3405.

Figure 55:
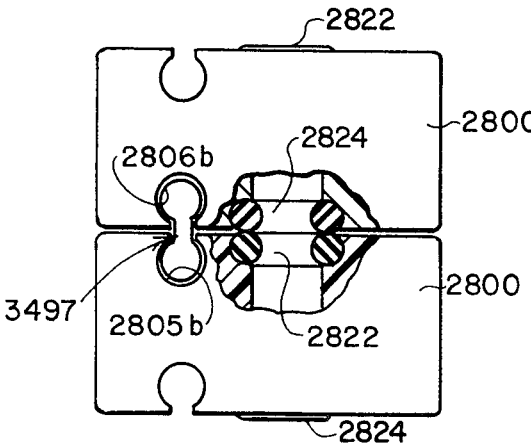
FIG. 55 is a side elevational view of several assembled components each constructed in accordance with certain aspects of the present invention, some of the components having portions broken away.
Figure 56:
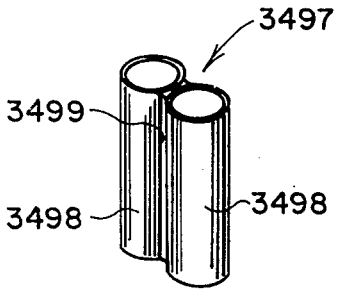
FIG. 56 is a perspective view of a connector element which may be used with components constructed in accordance with certain aspects of the present invention.

Referring to FIG. 55, two of the single conduit blocks 2800 are shown connected by a double male connector 3497. The connector 3497 is shown in FIG. 56 as comprising two cylinders 3498 and an integral joining rib 3499. Such connectors 3497 are known and form no part of the present invention.

As is illustrated in FIG. 55, when conduit blocks of the present invention, such as the blocks 2800, are joined by a connector, such as the connector 3497, the seals carried by the blocks, such as the seals 2822, 2824 compressively engage each other to establish fluid tight communication between aligned passages of the interconnected blocks.

Figure 57:
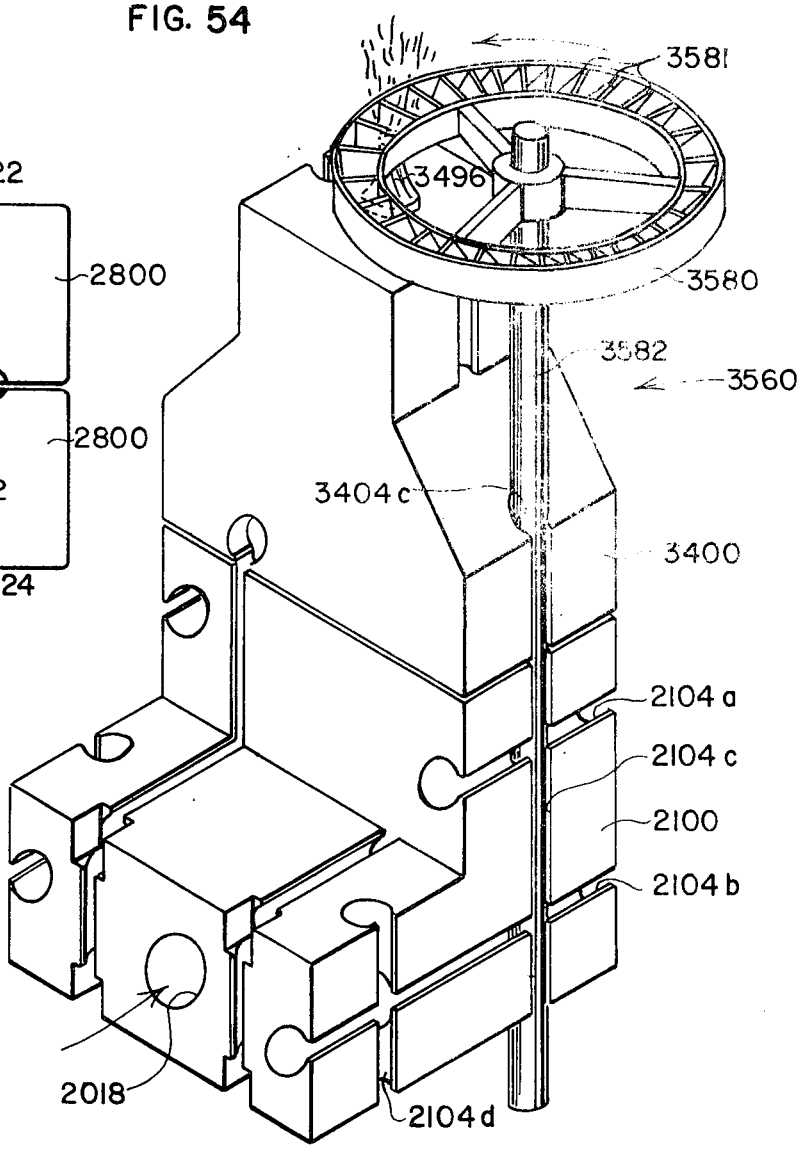
FIG. 57 is a perspective view of several assembled components each embodying certain aspects of the present invention.

Referring to FIG. 57, another assembly of a number of components of the present invention is indicated generally by the numeral 3560. Shown connected one to another is the "L-shaped single L" block 2100 and the "nozzle" block 3400. When fluid is pumped under pressure into the passage 2018, as by a pump to be described, it is transmitted through the blocks 2100, 3400 and discharges through the nozzle tip 3496. A vaned wheel 3580 is positioned such that some of its vanes 3581 overlie the nozzle tip 3496. A shaft 3582 supports the wheel 3580. The shaft 3582 is journaled in the aligned grooves 2104*c*, 3404*c*. When fluid is ejected from the nozzle tip 3496, it strikes the wheel vanes 3581 causing the wheel 3580 to rotate about the axis of the shaft 3582. Various other rotors, impellers and movable fluid responsive members can likewise be used with the components of the present invention. Special nozzles of various types can be used to create fountain displays, and electrically operated valves can be used to provide programmed changes in the fountain displays.

As will be apparent from the foregoing description in the preferred practice of the present invention, each of the building blocks has a separate O-ring seal provided where each of its conduits or passages or branches opens through a block face. One benefit of providing O-rings at each such face opening is that when two blocks are interconnected, two seals cooperate to provide a fluid tight connection between aligned passages. If one of the engaged seals is slightly worn, the other seal will tend to compensate for such wear.

A further advantage of providing a seal at each face opening is that it permits the blocks to be reversible connected and adds versatility to the construction set. Still another advantage is that tubular members such as are shown in FIG. 51 can be connected to each face opening through the use of the seals provided adjacent each of the face openings.

Figure 58:
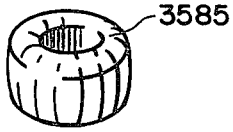
FIG. 58 is a perspective view of an alternate seal embodiment.
Figure 59:
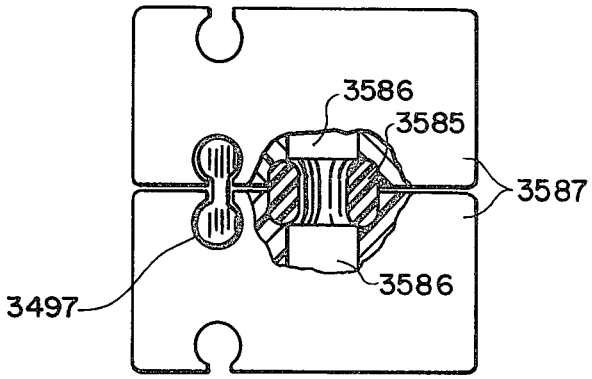
FIG. 59 is a side elevational view of several assembled components with portions broken away to illustrate the use of the seal embodiment of FIG. 58.
Figure 60:
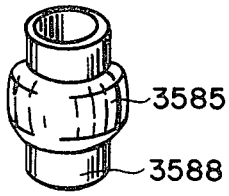
FIG. 60 is a perspective view of the seal embodiment of FIG. 58 positioned on a connector tube.
Figure 61:
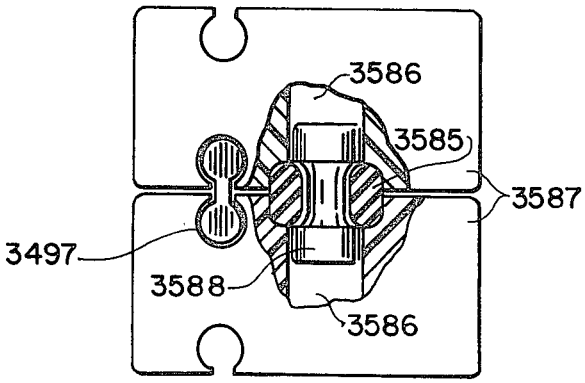
FIG. 61 is a side elevational view of several assembled components with portions broken away to illustrate the use of the seal and tube of FIG. 60.
Figure 62:
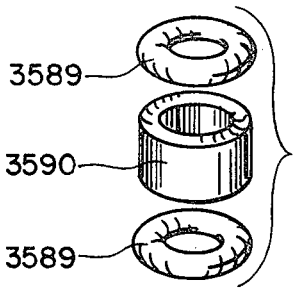
FIG. 62 is a perspective view of an alternate seal assembly.
Figure 63:
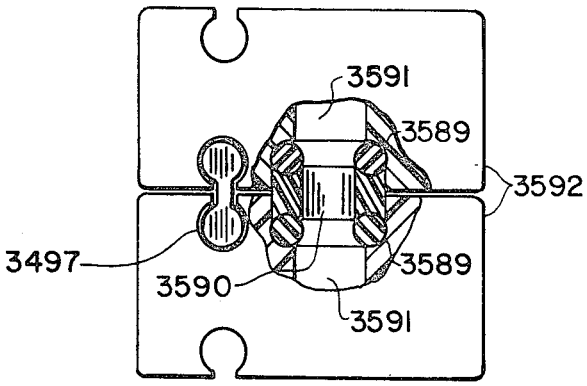
FIG. 63 is a side elevational view of several assembled components with portions broken away to illustrate the use of the seal assembly of FIG. 62.

Referring to FIGS. 58–63, several less preferable sealing arrangements are shown which can be used to provide less versatile building set components which are more difficult to assemble and disassemble. In FIGS. 58 and 59, a single elongated tubular seal structure 3585 is shown which can be used to seal the juncture of aligned conduits 3586 in two blocks 3587. In FIGS. 60, 61, the elongated seal 3585 is shown positioned on a nipple 3588 and is used to seal the juncture of the aligned conduits 3586. In FIGS. 62, 63 two O-rings seals 3589 are provided at opposite ends of a tube 3590 and are used to seal the juncture of aligned conduits 3591 formed in two blocks 3592.

A drawback of the arrangements shown in FIGS. 58–63 is that connectors such as the coupler 3497 must be used to join the blocks 3587, 3592 because the blocks 3587, 3592 are not relatively slidable once their seal structures are in place. Removing the couplers 3497 from such interconnected blocks can be difficult and may well require the assistance of an elongated punch-like tool.

Figure 64:
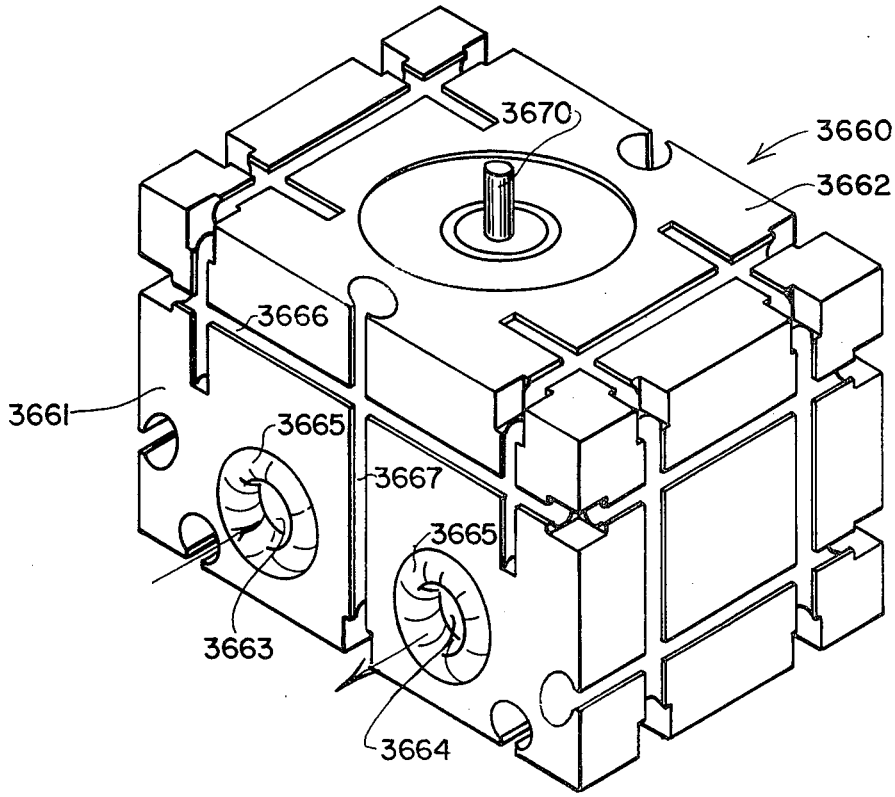
FIG. 64 is a perspective view of a fluidic operational device embodying certain aspects of the present invention.

Referring to FIG. 64, a fluid operating device is indicated generally by the numeral 3660. The device 3660 has a housing which is of right parallelepiped configuration. The housing has substantially rectangular faces including a side face 3661 and a top face 3662. A fluid input passage 3663 and a fluid output passage 3664 open through the side face 3661. O-ring seals 3665 are provided at the juncture of the passages 3663, 3664 with the face 3661, in the manner described in conjunction with the block 100. Undercut grooves 3666 and 3667 are provided in the face 3661 to permit both single and double conduit blocks to be connected to the device 3660 with their passages communicating with the passages 3663, 3664.

A shaft 3670 projects through the top face 3662 and extends into the housing of the device 3660 for connection with a rotatable impeller (not shown). The shaft 3670 and such impeller rotate together relative to the housing of the device 3660.

The device 3660 can be any of a number of fluid system components including a pump, a blower, a motor, etc. Where the device 3660 is a pump or blower, rotating the shaft 3670 will cause the device to draw fluid in through the passage 3663 and discharge fluid under pressure through the passage 3664. Where the device 3660 is a motor, fluid pumped under pressure into the passage 3663 and discharged through the passage 3664 will cause the impeller to rotate the shaft 3670. Since any of a wide number of conventional pump, blower and motor impeller arrangements can be used to form the internal structure of the device 3660, such structures need not be described here.

The device 3660 can alternatively have an internal structure which forms a valve. Where the device 3660 is a valve, the shaft 3670 can be rotated to effect a controlled fluid flow between the passages 3663, 3664. Since any of a wide variety of conventional valve structures can be employed within the housing of the device 3660, none need be described here.

The device 3660 can, as will be apparent, be internally structured to form a flow divider, in which case additional passages can be formed as required through other of the housing faces. Other internal structures can be used to form fluid devices capable of such functions as switching, amplifying, dividing and alternating fluid flows.

Figure 65:
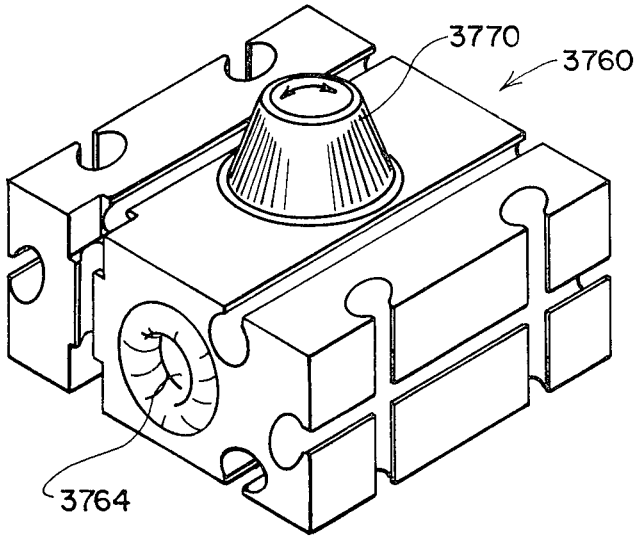
FIG. 65 is a perspective view of an adjustable fluidic valve structure embodying certain aspects of the present invention.

Referring to FIG. 65, still another fluid operating device is illustrated at 3760. The device 3760 has a right parallelepiped housing with a passage 3764 extending therethrough. A rotatable knob 3770 is provided much in the manner of the shaft 3670 in the device 3660. While the device 3760 as shown is intended to depit a simple valve for controlling the flow of fluid through the passage 3764, the device 3760 can of course alternately have an internal structure which forms a pump, blower, motor, or the like.

Figure 66:
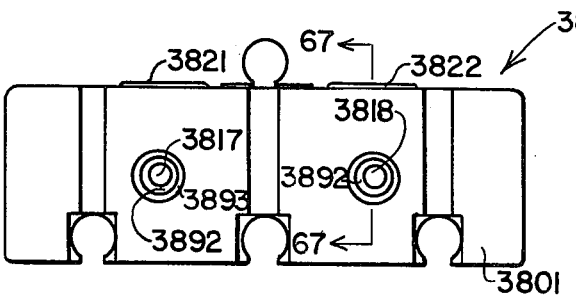
FIG. 66 is a side elevational view of a thirtieth construction block embodying certain aspects of the present invention.
Figure 67:
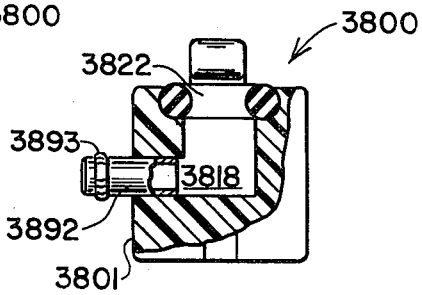
FIG. 67 is an end elevational view of the thirtieth block with portions broken away to a plane indicated by a line 67—67 in FIG. 66.

Referring to FIGS. 66 and 67, a "double L hose adapter" block is indicated generally by the numeral 3800. The block 3800 differs from the "double L" block 500 principally in that the passages 3817, 3818 have reduced diameters as they extend toward the face. A pair of tubular hose connectors 3892 are adhesively secured within these reduced diameter passage portions. Circumferential ribs 3893 are provided on the connectors 3892 to receive and retain a flexible hose which can be positioned over the connectors 3892 as will be explained.

Figure 68:
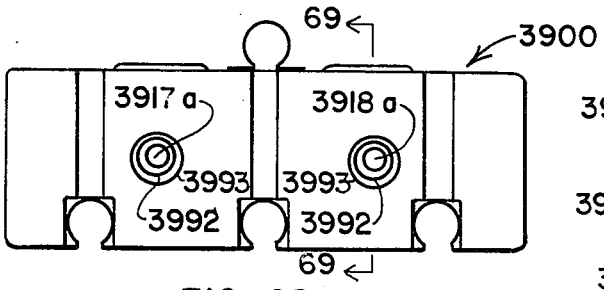
FIG. 68 is a side elevational view of a thirty-first construction block embodying certain aspects of the present invention.
Figure 69:
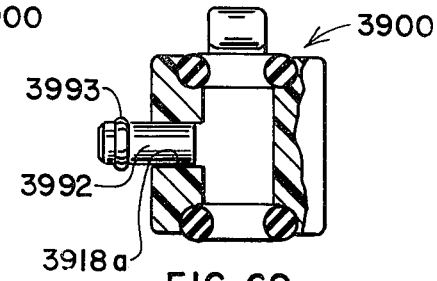
FIG. 69 is an end elevational view of the thirty-first block with portions broken away to a plane indicated by a line 69—69 in FIG. 68.

Referring to FIGS. 68 and 69, a "double T hose adapter" block is indicated generally by the numeral 3900. The block 3900 differs from the "double T" block 1400 much as the blocks 3800, 500 differ from each other. A pair of tubular hose connectors 3992 are adhesively secured in branch passages 3917*a*, 3918*a*. Circumferential ribs 3993 are provided on the connectors 3992.

Figure 70:
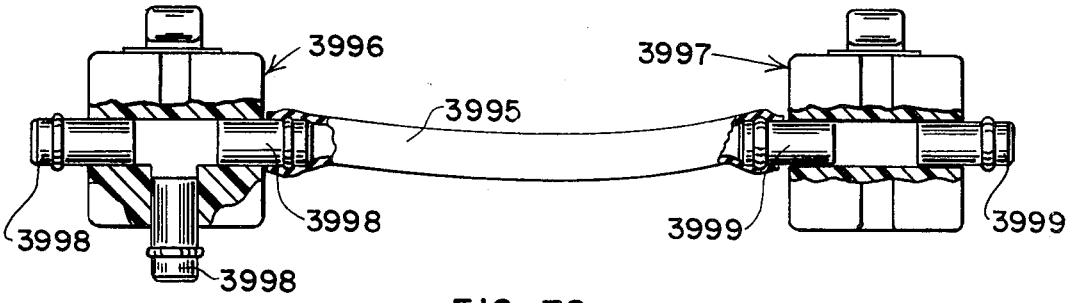
FIG. 70 is a side elevational view of several assembled components with portions of each component broken away to illustrate certain aspects of the present invention.

Referring to FIG. 70, a flexible hose 3995 is shown coupled to a pair of connector blocks 3996, 3997. Connectors 3998, 3999 are carried by the blocks 3996, 3997. As will be apparent, the hose 3995 has been positioned over connectors 3998, 3999 and is retained in place by frictional forces.

It is desirable to provide hose connector blocks such as the blocks 3800, 3900, 3996 and 3997 to enable certain of the previously described blocks to be adapted for connection to hoses. Hoses are used in the preferred practice of the present invention to transmit fluid between relatively movably mounted conduit system components. An example is where a stationary fluid pump is connected by hoses to a relatively movable fluid motor.

Figure 71:
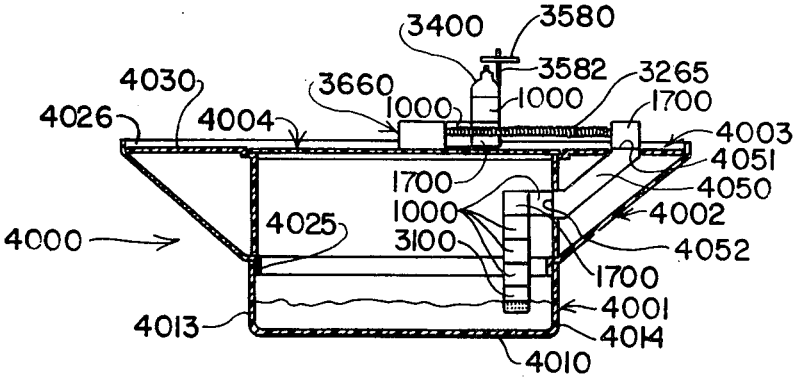
FIG. 71 is a cross-sectional view of a reservoir and base assembly as assembled in combination with certain of the components shown in previous FIGURES; and, FIG. 72 is an exploded view of the reservoir and base assembly of FIG. 71.
Figure 72:
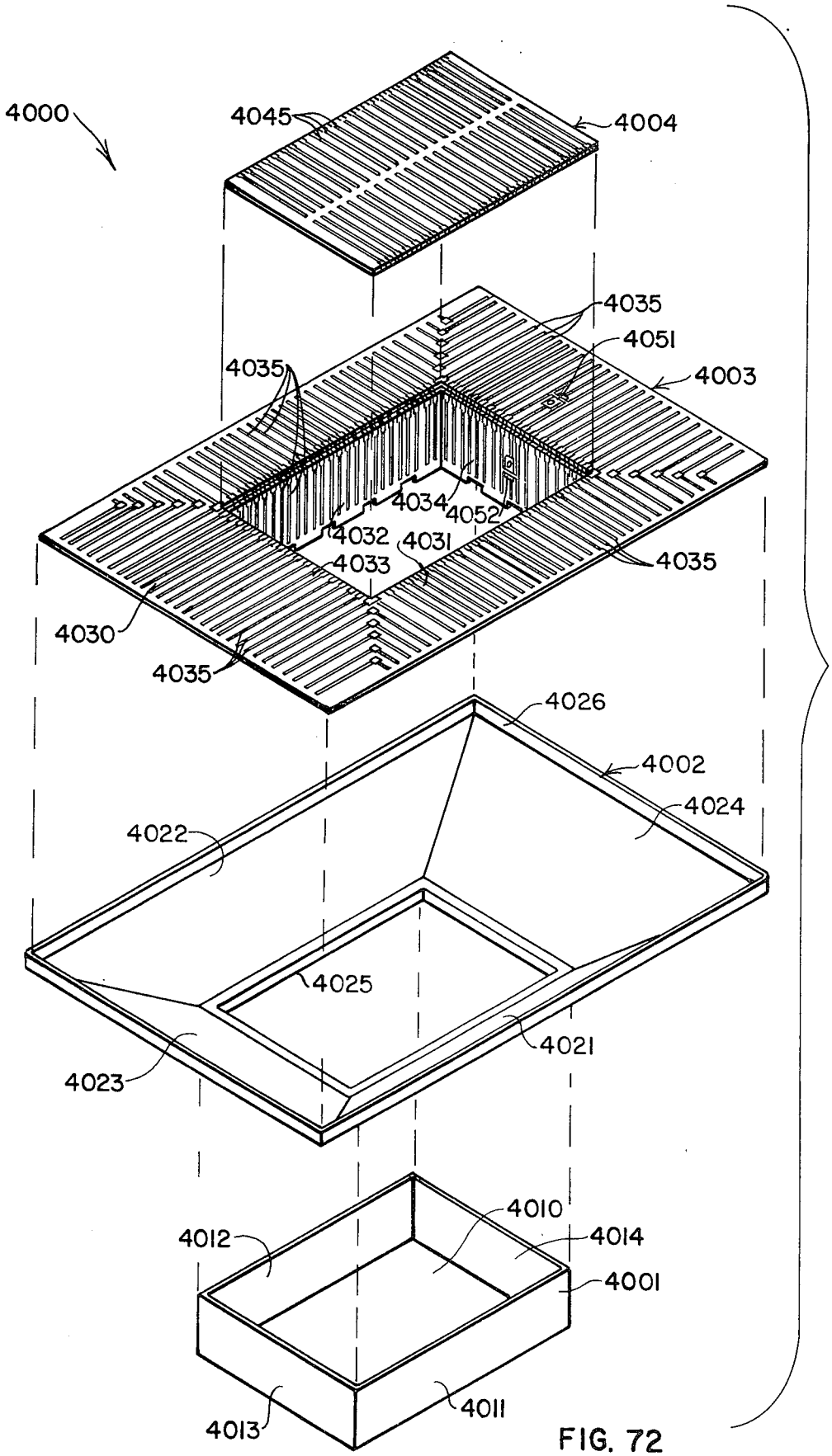

Referring to FIGS. 71 and 72, where a liquid such as water is to be used as the motive fluid transmitted through communicated components as described above, a combination reservoir and building base assembly 4000 is provided. The reservoir and base assembly 4000 has four nestable components including a rectangular reservoir pan 4001, an upstanding generally rectangular funnel 4002, a liner structure 4003, and a building base 4004. The pan 4001, the funnel 4002, the liner 4003, and the base 4004 are preferably all formed from relatively rigid plastic material.

The reservoir pan 4001 has a bottom wall 4010, two sidewalls 4011, 4012, and two end walls 4013, 4014.

The funnel 4002 has inclined sidewalls 4021, 4024. An integrally formed vertically depending flange 4025 extends around and joins the bottoms of the walls 4021–4024. An integrally formed upwardly extending flange 4026 extends around and joins the tops of the walls 4021, 4024.

The funnel 4002 is nestable with the pan 4001. As shown in FIG. 71, when the funnel 4002 is nested in the pan 4001, the bottom flange 4025 extends inside the pan walls 4011–4014. By this arrangement, water or other fluid medium which drops into the funnel 4002 is channeled into the reservoir pan 4001.

The liner structure 4003 is nestable within the funnel 4002. A horizontal mounting wall 4030 is defined by the liner structure 4003. Four vertical mounting walls 4031, 4032, 4033, 4034 depend from the wall 4030. The mounting walls 4030–4034 are provided with mounting slots 4035 for connection with such blocks as are described in the referenced End Connector Patent. The slots 4035 are preferably of such configuration as is described in the referenced Slotted Connector Patent.

The liner structure 4003 is nestable within the funnel 4002 as shown in FIG. 71. Any fluid which falls on the liner structure 4003 can pass through the slots 4035 for return by the funnel 4002 to the reservoir pan 4001.

The building base 4004 is a planar structure having slots 4045 similar to the slots 4035. The base 4004 is preferably provided with drain passages (not shown) which enable fluid which impinges on the base structure 4004 to pass into the reservoir pan 4001.

Referring to FIG. 71, a conduit 4050 extends between the walls 4030, 4032. The conduit 4050 has opposite ends 4051, 4052 adapted for connection to certain of the previously described blocks to facilitate communication from above the mounting wall 4030 with the reservoir pan 4001.

As is shown in FIG. 71, the base and reservoir assembly 4000 can be used with a number of the previously described components to form a fluid system which utilizes water as a working fluid.

In FIG. 71, an intake block 3100 is used to draw in water from the reservoir pan 4001. A series arrangement of blocks 1000 and 1700 connect the intake block 3100 to the conduit 4050. A "single side L" block 1700 connects the conduit 4050 with a flexible conduit member 3265. A pump 3660 draws water through the flexible conduit 3265 and discharges it through connected blocks 1000, 1700 to a nozzle block 3400. Water discharged from the nozzle block 3400 rotates a vaned wheel 3580.

Many other fluid system constructions can, of course, be built with components embodying the spirit of the present invention.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed.

What is claimed is:

1. A construction set, comprising:

a. a first member having a first fluid conduit formed therein and having a substantially planar first face, the first conduit opening through the first face to define a first opening;

b. a second member having a second fluid conduit formed therein and having a substantially planar second face, the second conduit opening through the second face to define a second opening;

c. the first and second members being movable, while retaining the first and second faces substantially in a common plane, between a disconnected position, wherein the first and second conduits do not align, to a connected position where the first and second conduits align;

d. connection means including slidingly interfittable formations on the first and second members for interconnecting such members as they are moved from the disconnected position to the connected position, and for releasing a connection between such members as they are moved from the connected position to the disconnected position;

e. first and second resilient annular seal means carried respectively in the first and second openings and having annular sealing portions which normally extend outwardly from such openings, the sealing portions of one of the seal means operating to compress the sealing portions of the other seal means as the members are moved from the disconnected position to the connected position, and cooperating to establish fluid-tight communication between the first and second conduits when the members are in the connected position;

f. a third member having first and second projections formed thereon, and a third conduit extending between and opening through the projections;

g. the first projection being configured to extend through and compressively engage the first seal means to establish fluid-tight communication between the first and third conduits; and, h. the second projection being configured to extend through and compressively engage the second seal means to establish fluid-tight communication between the second and third conduits.

2. The construction set of claim 1 wherein circumferentially extending grooves are formed on the first and second projections of the third member, and the first and second seal means engage such grooves when the projections are inserted respectively through the first and second seal means.

3. The construction set of claim 1 wherein the first and second members have formations adjacent the first and second faces which overlie portions of the first and second seal means to retain the first and second seal means on their respective members when the members are disconnected.

4. The construction set of claim 1 wherein:

a. the first member has a first auxiliary fluid conduit formed therein and opening through the first face to define a first auxiliary opening;

b. the second member has a second auxiliary fluid conduit formed therein and opening through the second face to define a second auxiliary opening;

c. the first and second auxiliary conduits being located within the first and second members such that the first and second auxiliary conduits align when the first and second members are in the connected position; and, d. first and second resilient annular auxiliary seal means are carried respectively in the first and second auxiliary openings and have annular sealing portions which normally extend outwardly from such auxiliary openings, the sealing portions of one of the auxiliary seal means operating to compress the sealing portions of the other auxiliary seal means as the first and second members are moved from the disconnected position to the connected position, and cooperating to establish fluid-tight communication between the first and second auxiliary conduits when the first and second members are in the connected position.

5. The construction set of claim 4 additionally including a fourth member having first and second auxiliary projections formed thereon, a fourth fluid conduit extending through the fourth member and opening through the first and second auxiliary projections, the first auxiliary projection being configured to extend through and compressively engage the first auxiliary seal means to establish fluid-tight communication between the first and fourth conduits, and the second auxiliary projection being configured to extend through and compressively engage the second auxiliary seal means to establish fluid-tight communication between the second and fourth conduits.

6. The construction set of claim 1 wherein each of said first and second seal means comprises an O-ring.

7. The construction set of claim 1 wherein one of said members is a fluid pump.

8. The construction set of claim 1 wherein one of said members is a fluid motor.

9. The construction set of claim 1 wherein one of said members is a nozzle.

10. The construction set of claim 1 wherein one of said members is a valve structure.

11. The construction set of claim 1 wherein said first and second members are interconnectable in an alternate manner which provides no communication between said first and second conduits.

12. The construction set of claim 1 wherein:

a. said first member has a first auxiliary face, and said second member has a second auxiliary face;

b. said first conduit opens through said first auxiliary face, and said second conduit opens through said second auxiliary face;

c. said first and second members are interconnectable in an alternate manner with said first and second auxiliary faces positioned substantially adjacent each other and with said auxiliary openings aligned one with another; and, d. auxiliary seal means is carried by at least one of said first and second members for establishing fluidtight communication between said aligned auxiliary face openings.

13. The construction set of claim 1 wherein said first and second members each have a substantially right parallelepiped configuration.

14. The construction set of claim 1 wherein said first and second fluid conduits have a substantially constant common diameter along the majority of their lengths, said first and second conduits having enlarged diameter portions in the vicinity of said first and second openings, and said first and second seal means being carried in said enlarged diameter portions.

15. The construction set of claim 14 wherein said first and second annular seal means each have an inner diameter less than that of said substantially constant common diameter, and the projections on said third member are insertable through said annular seal and into said substantially constant, diameter portions of said first and second conduits.

* * * * *